US005553469A

United States Patent [19]

Seidel

[11] Patent Number: 5,553,469

[45] Date of Patent: Sep. 10, 1996

[54] METHOD OF CONTROLLING THERMALLY ALTERABLE PROFILE OF WORKING ROLLS

[75] Inventor: Jürgen Seidel, Kreuztal, Germany

[73] Assignee: SMS Schloemann-Siemag Aktiengesellschaft, Düsseldorf, Germany

[21] Appl. No.: 157,770

[22] Filed: Nov. 24, 1993

[30] Foreign Application Priority Data

Nov. 25, 1992 [DE] Germany ..... 42 39 529.1

[51] Int. Cl.[6] ..... B21B 27/06

[52] U.S. Cl. ..... 72/13.4; 72/201

[58] Field of Search ..... 72/12, 13, 9, 21, 72/200, 201, 202, 12.2, 13.4, 14.1

[56] References Cited

U.S. PATENT DOCUMENTS

| | | | |
|---|---|---|---|
| 2,692,118 | 10/1954 | Holloway | 72/200 |
| 4,422,318 | 12/1983 | Christ et al. | 72/201 |
| 4,612,788 | 9/1986 | Kitagawa | 72/13 |
| 4,706,480 | 11/1987 | Svatos | 72/201 |
| 4,741,193 | 5/1988 | Kimura et al. | 72/201 |

FOREIGN PATENT DOCUMENTS

| | | | |
|---|---|---|---|
| 54-23060 | 2/1979 | Japan . | |
| 1-15208 | 1/1989 | Japan | 72/200 |
| 2080719 | 2/1982 | United Kingdom | 72/200 |

*Primary Examiner*—Lowell A. Larson
*Assistant Examiner*—Thomas C. Schoeffler
*Attorney, Agent, or Firm*—Anderson Kill Olick & Oshinsky, P.C.

[57] ABSTRACT

A method of controlling thermally alterable profiles of working rolls during hot rolling of strips having different width includes providing cover shells for the working roll, determining a position of edges of the rolling strip on the working roll, determining a position of thermally isolating cover shells, which cover longitudinal portions of the working roll in a region of the strip edges for influencing a temperature gradient of the working roll, and displacing the cover shells to selectively cover a longitudinal region of the working roll in a strip edge-contact region of the working roll with the rolling strip, and a longitudinal region of the working roll which does not contact the rolling strip during strip rolling. The cover shells and a mechanism for displacing the cover shells are parts of an arrangement for effecting the method.

7 Claims, 3 Drawing Sheets

2'''

2''

2
3
3

2'
1

METHOD OF CONTROLLING THERMALLY ALTERABLE PROFILE OF WORKING ROLLS

BACKGROUND OF THE INVENTION

The invention relates to a method of and an arrangement for controlling a the thermally alterable profile of working rolls during rolling of a strip material having different widths. During hot rolling of a strip material, the working roll camber constantly increases, with the increase of the throughput of the strip material, due to the influence of the thermal load, if no correction is provided. Because of so changed thermal camber, the working roll profile deviates from a predetermined one.

It is known to control the thermally alterable profile with regard to the rolled strip center by appropriate adjusting means, such as displacement and/or flexural member, e.g., "CVC"—displacement or an appropriate cooling, to adjust the actual profile of the working roll to its predetermined profile. However, the roll profile in the region of the contact with the strip edges cannot be sufficiently adjusted by conventional means. Also, cyclical shifting of the working rolls relative to each other for rolling strips with different widths does not result in any improvement of the thermally alterable profile of the working roll in the contact region of the working roll with the strip edges.

Accordingly, the object of the invention is a method of and an arrangement for controlling the thermally alterable profile of a working roll which permit to adapt the actual profile of the working roll, during rolling of band materials, in particular, in the contact region of the working roll with the strip edges, to the predetermined profile of the working roll.

SUMMARY OF THE INVENTION

This and other objects of the present invention, which will become apparent hereinafter, are achieved by providing a method which includes providing cover shells for the working roll, determining a position of edges of the rolling strip on the working roll, determining a position of thermally isolating cover shells, which cover longitudinal portions of the working roll in a region of the strip edges for influencing a temperature gradient of the working roll, and displacing the cover shells to selectively cover a longitudinal region of the working roll in a strip edge contact region of the working roll with the rolling strip, and a longitudinal region of the working roll which does not contact the rolling strip during strip rolling. By these measures, it is achieved that, the working roll, in the contact region with the strip edges, is kept hot, so that the thermal camber in the covered region broadens, and a steep drop of the camber, resulting from rapid removal of heat, is shifted further outward.

It is especially advantageous to calculate the thermally alterable profile of a working roll in the contact region with strip edges in a computer on a basis of a computational model or to measure the thermal camber and/or the temperature gradient of the working roll in the axial direction to thereby determine the position of the cover shell, in which the thermal camber is best compensated and the steep drop is shifted outward as far as possible.

If, in addition, the known methods, e.g., the cyclical shifting of the working rolls for strips of different widths, are used, even greater adjustment, for example, averaging of the thermal camber in strip edge-contact region, is obtained.

A controlled application of cooling medium to the middle region of the working roll, as well as protecting the cover shells, e.g., by seals, from the cooling medium, provide even better matching of the actual profile of the thermally alterable working roll to its predetermined profile. According to the invention, it is also contemplated to adjust the temperature of the cover shells.

The arrangement for effecting the method according to the present invention includes at least one pair of thermal cover shells for partially circumferentially covering longitudinal regions of the working roll, and means for displacing the cover shells in an axial direction of the working roll for positioning of the cover shells at least in accordance with positions of edges of the rolling strip. The arrangement insures corresponding averaging of the temperatures as in the strip edge contact regions of the working roll with the strip so in the region of the working roll with no contact with the strip.

The arrangement according to the present invention also may include a computer for calculating the thermal camber of the working roll, or measuring rolls and/or temperature sensors for determining the thermal camber of the working roll.

The adjustment of the profile of the working roll can be effected by providing the cover shells on a strip outlet side of the working roll, and heating means in a strip edge-contact region on a strip inlet side of the working roll. The arrangement, when heating means are used, includes means for displacing the heating means in an axial direction of the working roll, and means for positioning of the heating means in accordance with positions of the strip edges. The positioning means may be a part of control means for positioning the cover shells.

Advantageously, the arrangement according to the invention includes drive means for displacing the cover shells and the heating devices, if for latter are used, toward and away from the working roll to enable replacement of the rolls.

The displacing means for the cover shells and that for the heating devices includes two spaced guides extending parallel to the working roll and formed as threaded bars, and nut means for guiding the cover shell along the guides. The guide bars have each, on opposite end portions thereof, right-hand and left-hand threads, respectively, the arrangement is further provided with a motor for rotating the guides, and a chain for synchronizing rotation of the guides.

Alternatively, two parallel guide struts for guiding the cover shells or the heating devices and a threaded bar, having oppositely directed threads and arranged intermediate the guide struts for displacing the cover shells, may be provided at the working roll. The displacement means for the cover shells and the heating devices may include each a hydraulic cylinder for displacing the respective cover shell or the heating device.

The adjustment of the working roll profile is improved when the cover shells are formed not as passive elements but include heating and/or cooling means for acting on the covered region of the working roll.

When a cooling medium is used for altering the thermal camber, to protect the strip edge-contact region, seals and, if necessary, air pressure nozzles are used for blow drying respective regions of the working roll.

According to the invention, the cover shells may be advantageously provided with tempering device which, e.g., may be in a form of an induction heater. Alternatively, the tempering device may include water spraying nozzle means for spraying onto a respective longitudinal region of the working roll, which is covered by a respective cover shell, lukewarm water.

The heating devices, when used, may be arranged in the axial direction of the working roll, and may be actuatable regionwise by an appropriate control device, which may be a part of the control device for controlling the displacement of the cover shells.

The cover shells may have a rectangular shape, as well as, a trapezoidal, triangular or circular shape.

BRIEF DESCRIPTION OF THE DRAWINGS

The features and objects of the present invention will become more apparent, and the invention itself will be best understood from the following detailed description of the preferred embodiment when read with reference to the appended drawings, wherein.

DETAILED DESCRIPTION OF THE PREFERRED EMBODIMENT

Figures 1A, 1B, 1C, 1D:
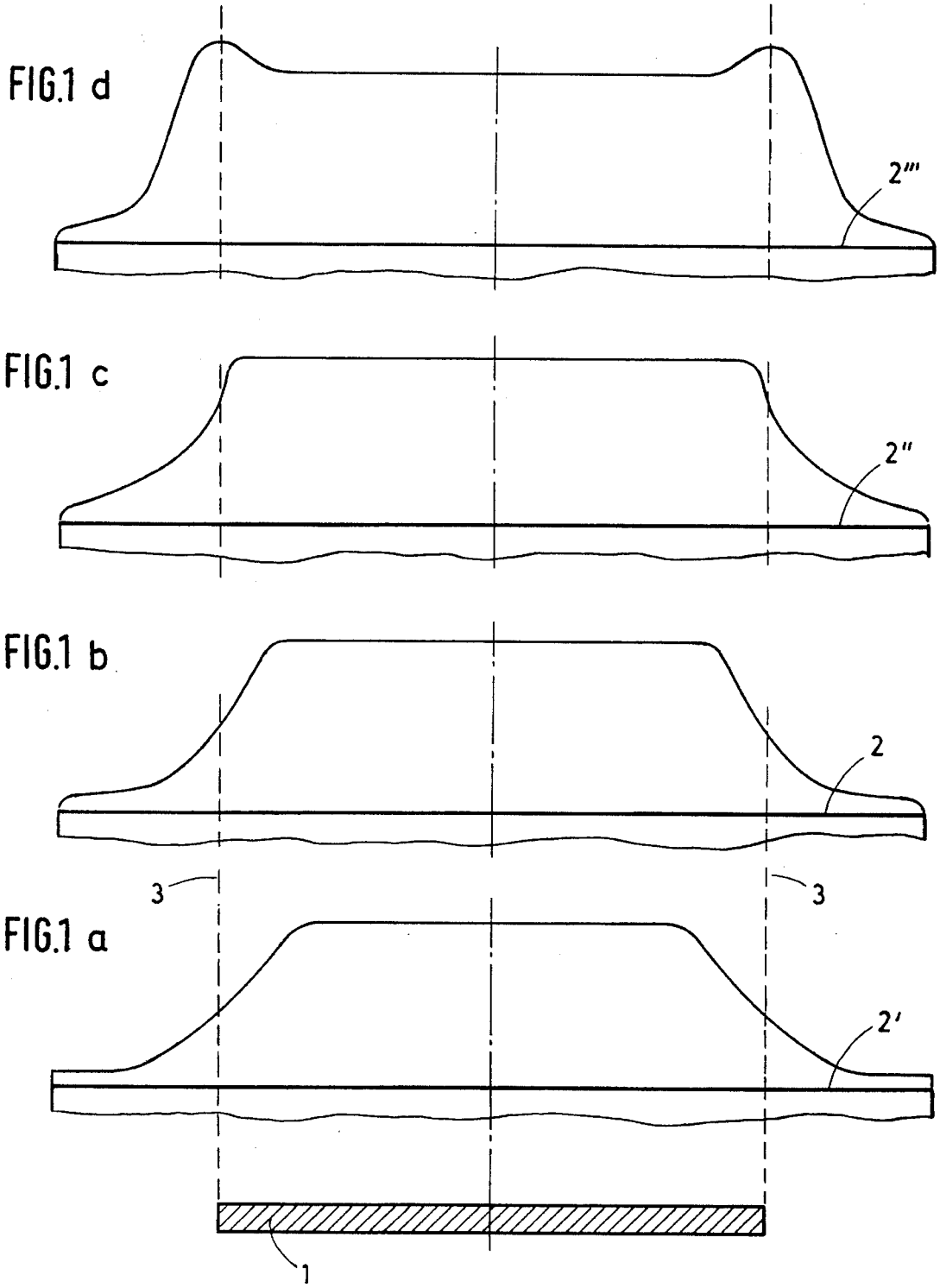
FIGS. 1*a*–1*d* show a thermally altered profile of a working roll at different operational conditions.

FIG. 1 shows a working roll 2, 2', 2", 2'" arranged above a strip 1 and having a thermally altered profile resulting from four different operational conditions. At an operational condition shown in FIG. 1*a* the working roll 2' has a conventional profile. A substantial drop of the thermally altered camber can be seen there, which results, during rolling of the strip, in increased flatness/profile errors in the region of the strip edges.

At an operational condition shown in FIG. 1*b* the working roll 2 is covered with cover shells in the region of the strip edges. The thermal curve of the camber, in comparison with a conventional thermal camber, is displaced outward. This results in reduced flatness/profile errors in the region of the strip edges.

At an operational condition shown in FIG. 1*c* the working rolls 2'", in addition to being covered with cover shells, are cyclically shifted in axial direction. As can be seen here, the same thermal camber is available along the entire strip width.

At an operational condition shown in FIG. 1*d* a large surface area of the working roll in the strip edge-contact region is covered with the covering shells. Here, a substantially thermally affected camber is present in the middle region of the working roll. A significant drop of the thermal camber first begins outside of the strip edge-contact region. An optimal displacement position of the cover shells, e.g., between operational conditions b) and d) can be calculated on a basis of computational models.

Figure 2:
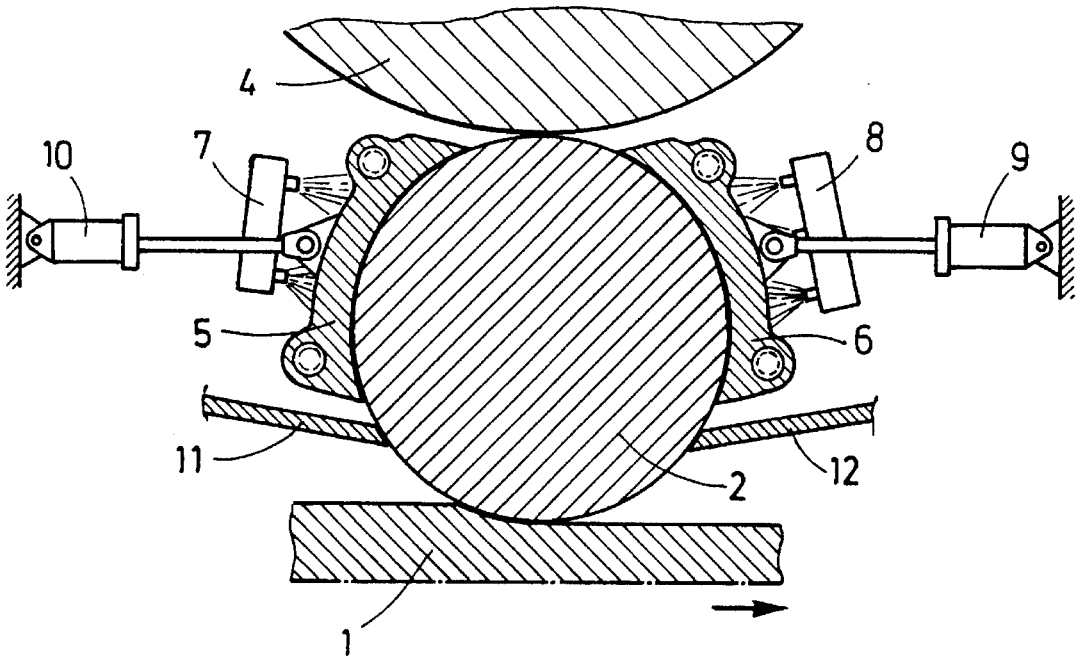
FIG. 2 shows a side view of a working roll with cover shells.

FIG. 2 shows the strip is the working roll 2 and a portion of a back-up roll 4. The cover shells 5 and 6 for the working roll 2 are provided on the strip inlet and strip outlet sides of the working roll 2, respectively. The cooling of the middle region of the working roll 2 is effected with cooling devices 7 and 8. The drives 9 and 10 associated with the cover shells 5 and 6, respectively, serve for pulling the respective cover shells away from the working roll to be able to perform a necessary maintenance or to replace the working roll. Conventional wipers 11, 12 prevent the cooling medium from reaching the rolling strip.

Figure 3:
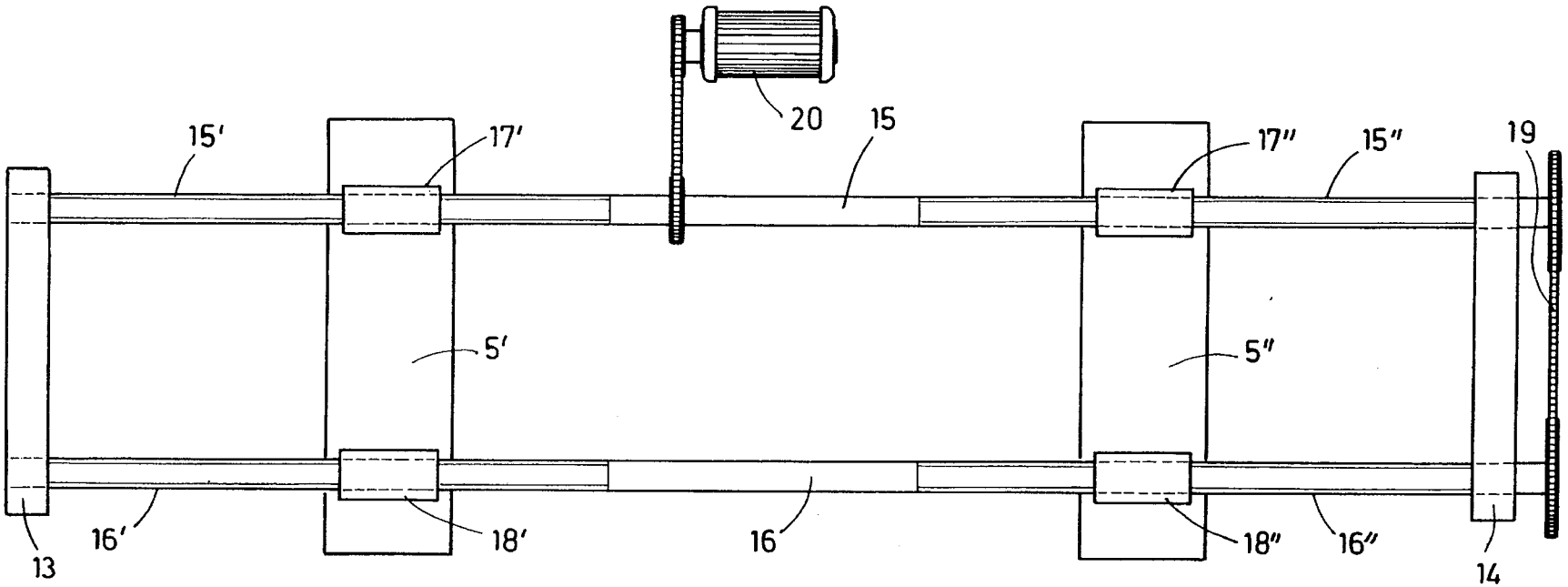
FIG. 3 shows a front view of a cover shell for a working roll (not shown).

FIG. 3 shows bearing blocks 13 and 14 for rotatably supporting the guides 15 and 16. The guides 15 and 16 are provided, on opposite sides of their respective middle regions, with right-handed threads 15', 16' and left-handed threads 15", 16". The cover shells 5' and 5" are displaced, along the guides 15 and 16 in the regions of threads 15', 16', and 15", 16", respectively, by means of nuts 17', 18' and 17", 18", respectively. The rotational movement of the guides 15, 16 is synchronized by a chain 19. A motor 20 is provided for rotating the guides 15, 16. The appropriate displacement of the nuts 17', 17", and 18', 18", upon actuation of the motor 20 in a respective direction, would provide for displacement of the cover shells 5' and 5" toward each other or away from each other. The drive 10, which is not shown in FIG. 3, is connected with the bearing blocks 13 and 14 for retaining the same to thus enable the movement of the cover shells for the working roll 2 toward and away from the working roll 2.

While a particular embodiment of the present invention has been shown and described, various modifications thereof will be apparent to those skilled in the art, and therefore, it is not intended that the present invention be limited to the disclosed embodiment and or details thereof, and departures may be made therefrom within the spirit and scope of the appended claims.

What is claimed is:

1. A method of controlling a thermally alterable profile of a working roll during rolling of a strip material, said method comprising the steps of:

providing at least one pair of thermally isolating cover shells for the working roll;

determining a position of opposite edges of the rolled strip material on the working roll;

determining a position of the cover shells in which the cover shells are spaced from each other and cover respective opposite longitudinal regions of the working roll in contact with respective opposite edges of the rolled strip material; and displacing the cover shells to cover the respective opposite edge-contacting longitudinal regions of the working rolls and respective adjacent outside longitudinal regions of the working rolls which do not contact the rolled strip material during rolling of the strip material.

2. A method as set forth in claim 1, wherein said cover shell position determining step includes calculation of a thermal camber of the working roll in an axial direction on a basis of a computational model, said method further comprising the step of displacing the cover shells in such a manner that developing, in the strip edge-contact opposite regions of the working roll, thermal deviations from a predetermined profile of the working roll oppose each other.

3. A method as set forth in claim 1, wherein said cover shell position determining step includes measuring one of thermal camber and roll temperature in an axial direction of the working roll, said method further comprising the step of displacing the cover shells in such a manner that thermal deviations from a predetermined profile of the working roll, which develop in the strip edge-contact opposite regions of the working roll, oppose each other.

4. A method as set forth on claim 1, wherein each cover shell is formed of two axially spaced shell elements; said method further comprising a step of applying a cooling medium to axial regions between respective two shell elements, with effecting cooling medium distribution in accordance with a calculated thermal camber of the working roll between the two shell elements, and in such a manner that thermal cambers on a predetermined profile of the working roll in the opposite regions of the working roll are matched with each other.

5. A method as set forth in claim 4, wherein said cooling medium applying step includes sealing of the longitudinal regions of the working roll, which are covered with the two cover shells and are located opposite axial regions of the working roll to which the cooling medium is applied, from the cooling medium.

6. A method as set forth in claim 1, comprising the step of adjusting temperatures of the cover shells.

7. A method as set forth in claim 6, wherein said temperature adjusting step includes adjusting axial distribution of the temperature of the cover shells.

* * * * *